US008953001B2

(12) United States Patent
Kim

(10) Patent No.: US 8,953,001 B2
(45) Date of Patent: Feb. 10, 2015

(54) METHOD OF DIGITAL-DRIVING AN ORGANIC LIGHT EMITTING DISPLAY DEVICE

(71) Applicant: Samsung Display Co., Ltd., Yongin, Gyeonggi-Do (KR)

(72) Inventor: Do-Ik Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 121 days.

(21) Appl. No.: 13/661,196

(22) Filed: Oct. 26, 2012

(65) Prior Publication Data

US 2013/0314456 A1 Nov. 28, 2013

(30) Foreign Application Priority Data

May 25, 2012 (KR) ..... 10-2012-0055919

(51) Int. Cl.
*G09G 3/30* (2006.01)

(52) U.S. Cl.
USPC ..... 345/691; 345/76; 345/211

(58) Field of Classification Search
CPC ..... G09G 3/30; G09G 3/32; G09G 3/3208; G09G 3/3216; G09G 3/3225; G09G 3/2022; G09G 3/2033; G09G 2310/0224; G09G 2320/02; G09G 2320/0266; G09G 2320/0247
USPC ..... 345/76–83, 204, 211–215, 690–693
See application file for complete search history.

(56) References Cited

U.S. PATENT DOCUMENTS

| | | | | |
|---|---|---|---|---|
| 2006/0284189 | A1* | 12/2006 | Sakata et al. | 257/79 |
| 2007/0103418 | A1* | 5/2007 | Ogino et al. | 345/89 |
| 2008/0111835 | A1* | 5/2008 | Hu | 345/690 |
| 2008/0111837 | A1* | 5/2008 | Kim et al. | 345/690 |
| 2008/0191977 | A1* | 8/2008 | Park et al. | 345/82 |
| 2008/0246699 | A1* | 10/2008 | Oh | 345/76 |
| 2008/0266215 | A1* | 10/2008 | Ryu et al. | 345/76 |
| 2009/0015522 | A1* | 1/2009 | Ono | 345/76 |

(Continued)

FOREIGN PATENT DOCUMENTS

| | | | |
|---|---|---|---|
| KR | 10-2008-0047922 | A | 5/2008 |
| KR | 10-0826508 | B1 | 5/2008 |

(Continued)

OTHER PUBLICATIONS

Applicants' cross-referenced copending U.S. Appl. No. 13/661,158, filed Oct. 26, 2012 (not yet published).

*Primary Examiner* — Alexander Eisen
*Assistant Examiner* — Abhishek Sarma
(74) *Attorney, Agent, or Firm* — Robert E. Bushnell, Esq.

(57) ABSTRACT

A method of digital-driving an organic light emitting display device, which divides one frame into a plurality of sub-frames, is provided. In this method, a total number of scan operations, which are to be performed during the frame, is calculated based on a number of scan-lines and a number of the sub-frames, an emission time of each of the sub-frames is set based on a gray level maximum value and the total number of the scan operations, the emission times of the sub-frames are modified by permitting errors to the emission times of the sub-frames to control a sum of the emission times of the sub-frames to be equal to the total number of the scan operations, and each sub-frame scan timing of the scan-lines is sequentially shifted by N horizontal scan intervals, where N is the number of the sub-frames.

16 Claims, 10 Drawing Sheets

(56) References Cited

U.S. PATENT DOCUMENTS

| | | | | |
|---|---|---|---|---|
| 2009/0027369 | A1* | 1/2009 | Lee et al. | 345/204 |
| 2009/0058261 | A1* | 3/2009 | Kawakami et al. | 313/503 |
| 2009/0207107 | A1* | 8/2009 | Chung et al. | 345/76 |
| 2009/0219233 | A1* | 9/2009 | Park | 345/80 |
| 2009/0322724 | A1* | 12/2009 | Smith | 345/211 |
| 2010/0053223 | A1* | 3/2010 | Otsuka et al. | 345/690 |
| 2011/0298832 | A1* | 12/2011 | Lai et al. | 345/690 |
| 2012/0306944 | A1* | 12/2012 | Sangam et al. | 345/691 |

FOREIGN PATENT DOCUMENTS

| | | | |
|---|---|---|---|
| KR | 10-2009-0043305 | A | 5/2009 |
| KR | 10-2011-0056643 | A | 5/2011 |

* cited by examiner

METHOD OF DIGITAL-DRIVING AN ORGANIC LIGHT EMITTING DISPLAY DEVICE

CROSS-REFERENCE TO RELATED APPLICATION(S)

This application claims priority under 35 USC §119 to Korean Patent Applications No. 10-2012-0055919, filed on May 25, 2012 in the Korean Intellectual Property Office (KIPO), the contents of which are incorporated herein in its entirety by reference. Furthermore, the present application is related to a co-pending U.S. application Ser. No. 13/661,158, entitled METHOD OF DIGITAL-DRIVING AN ORGANIC LIGHT EMITTING DISPLAY DEVICE, based upon Korean Application No. 10-2012-0055388, filed on May 24, 2012 in the Korean Intellectual Property Office (KIPO).

BACKGROUND

1. Field of the Invention

Example embodiments relate generally to a method of driving an organic light emitting display device. More particularly, embodiments of the inventive concept relate to a method of digital-driving an organic light emitting display device.

2. Description of the Related Art

Recently, an organic light emitting display device is widely used as a flat display device as an electric device is getting smaller and consuming lower power. Generally, an organic light emitting display device (i.e., displays) implements a specific gray level using a voltage stored in a storage capacitor of each pixel (i.e., an analog driving technique for an organic light emitting display device). However, the analog driving technique may not accurately implement a desired gray level because the analog driving technique uses the voltage (i.e., an analog value) stored in the storage capacitor of each pixel.

To overcome these problems, a digital driving technique for an organic light emitting display device has been suggested. In detail, the digital driving technique displays one frame by displaying a plurality of sub-frames. That is, in the digital driving technique, one frame is divided into a plurality of sub-frames, each emission time of the sub-frames is differently set (e.g., by a factor of 2), and a specific gray level is displayed using a sum of emission times of the sub-frames.

Typically, when the digital driving technique divides one frame into a plurality of sub-frames, a blank sub-frame that displays a black color necessarily exist as one of the sub-frames. Thus, a total emission time of one frame may be reduced by the blank sub-frame. As a result, since the digital driving technique needs to increase a luminance to compensate a reduction of the total emission time, an element lifetime may be reduced in the organic light emitting display device. In addition, a display panel driving timing may be insufficiently achieved because it takes time to perform specific operations for the blank sub-frame in the organic light emitting display device.

SUMMARY OF THE INVENTION

Some example embodiments provide a method of digital-driving an organic light emitting display device capable of efficiently eliminating a blank sub-frame when dividing one frame into a plurality of sub-frames.

According to some example embodiments, a method of digital-driving an organic light emitting display device that divides one frame into a plurality of sub-frames and displays one frame by displaying the plurality of sub-frames may include a step of calculating a total number of scan operations, which are to be performed during the frame based on a number of scan-lines and a number of the sub-frames, a step of setting an emission time of each of the sub-frames based on a gray level maximum value and the total number of the scan operations, and a step of modifying the emission times of the sub-frames by permitting errors to the emission times of the sub-frames to control a sum of the emission times of the sub-frames to be equal to the total number of the scan operations, and a step of sequentially shifting each sub-frame scan timing of the scan-lines by N horizontal scan intervals, where N is the number of the sub-frames.

In example embodiments, each of the sub-frames may correspond to each bit of a data signal, and a gray level may be implemented based on the sum of the emission times of the sub-frames.

In example embodiments, a sub-frame having the longest emission time among the sub-frames may correspond to a most significant bit of the data signal, and a sub-frame having the shortest emission time among the sub-frames may correspond to a least significant bit of the data signal.

In example embodiments, a sub-frame emission order for the scan-lines may be set in order of increasing of the emission times of the sub-frames.

In example embodiments, a sub-frame emission order for the scan-lines may be set in order of decreasing of the emission times of the sub-frames.

In example embodiments, the step of calculating the total number of the scan operations may include a step of setting the total number of the scan operations as a value that is generated by multiplying the number of the scan-lines by the number of the sub-frames.

In example embodiments, the step of setting the emission time of the each of the sub-frames may include a step of setting the shortest emission time among the emission times of the sub-frames as M horizontal scan intervals, where M is a positive integer, when a value that is generated by multiplying the gray level maximum value by M is approximate to the total number of the scan operations.

In example embodiments, the each emission time of the sub-frames may differ by a factor of 2.

In example embodiments, the step of modifying the emission times of the sub-frames may include a step of calculating a difference between the total number of the scan operations and the value that is generated by multiplying the gray level maximum value by the M, and a step of distributing the difference to the emission times of the sub-frames while controlling the scan operations of the sub-frames of one scan-line not to be overlapped by the scan operations of the sub-frames of another scan-line.

According to some example embodiments, a method of digital-driving an organic light emitting display device that divides one frame into a plurality of sub-frames and displays one frame by displaying the plurality of sub-frames while driving odd scan-lines and even scan-lines at an interval corresponding to 1/F frame, where F is an integer greater than or equal to 2, may include a step of calculating a total number of scan operations, which are to be performed during the frame based on a number of scan-lines and a number of the sub-frames, a step of setting an emission time of each of the sub-frames based on a gray level maximum value and the total number of the scan operations, a step of modifying the emission times of the sub-frames by permitting errors to the emission times of the sub-frames to control a sum of the emission times of the sub-frames to be equal to the total number of the scan operations, and a step of shifting a sub-frame scan timing of a (K+F)th scan-line, where K is a positive integer, from a sub-frame scan timing of a K-th scan-line by N horizontal scan intervals, where N is the number of the sub-frames.

In example embodiments, each of the sub-frames may correspond to each bit of a data signal, and a gray level may be implemented based on the sum of the emission times of the sub-frames.

In example embodiments, a sub-frame having the longest emission time among the sub-frames may correspond to a most significant bit of the data signal, and a sub-frame having the shortest emission time among the sub-frames may correspond to a least significant bit of the data signal.

In example embodiments, a sub-frame emission order for the scan-lines may be set in order of increasing of the emission times of the sub-frames.

In example embodiments, a sub-frame emission order for the scan-lines may be set in order of decreasing of the emission times of the sub-frames.

In example embodiments, the step of calculating the total number of the scan operations may include a step of setting the total number of the scan operations as a value that is generated by multiplying the number of the scan-lines by the number of the sub-frames.

In example embodiments, the step of setting the emission time of the each of the sub-frames may include a step of setting the shortest emission time among the emission times of the sub-frames as M horizontal scan intervals, where M is a positive integer, when a value that is generated by multiplying the gray level maximum value by M is approximate to the total number of the scan operations.

In example embodiments, the each emission time of the sub-frames may differ by a factor of 2.

In example embodiments, the step of modifying the emission times of the sub-frames may include a step of calculating a difference between the total number of the scan operations and the value that is generated by multiplying the gray level maximum value by the M, and a step of distributing the difference to the emission times of the sub-frames while controlling the scan operations of the sub-frames of one scan-line not to be overlapped by the scan operations of the sub-frames of another scan-line.

Therefore, a method of digital-driving an organic light emitting display device according to example embodiments may efficiently eliminate a blank sub-frame (i.e. may achieve a sufficient driving margin) to increase a total emission time when dividing one frame to a plurality of sub-frames. As a result, an element lifetime may be increased, a display panel driving timing may be sufficiently achieved, and charging-discharging power consumption for data-lines may be reduced in the organic light emitting display device.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1A:
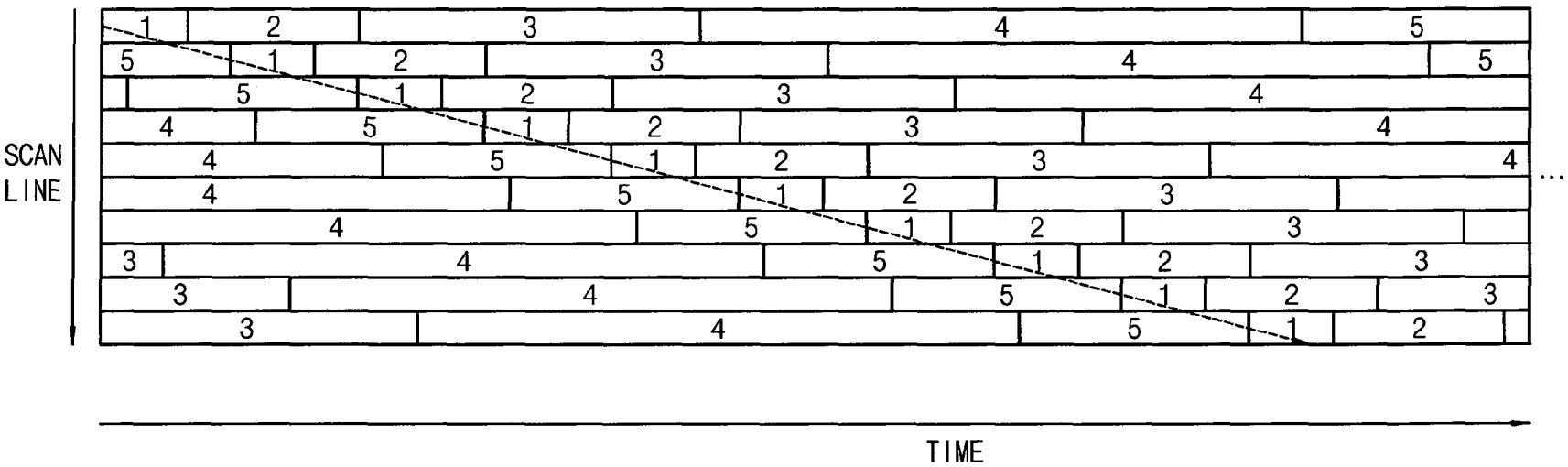
FIG. 1A (PRIOR ART)
FIG. 1A is a diagram illustrating a conventional digital driving technique of a random scan manner for an organic light emitting display device.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1B:
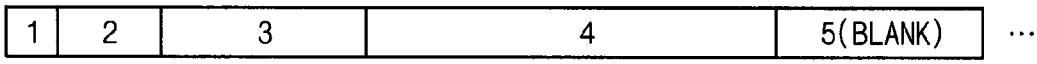
FIG. 1B (PRIOR ART)
FIG. 1B is a diagram illustrating an example in which one frame is divided into a plurality of sub-frames by a method of FIG. 1A.

FIG. 1A is a diagram illustrating a conventional digital driving technique of a random scan manner for an organic light emitting display device. FIG. 1B is a diagram illustrating an example in which one frame is divided into a plurality of sub-frames by a method of FIG. 1A.

Referring to FIGS. 1A and 1B, one frame is divided into a plurality of sub-frames. In FIGS. 1A and 1B, it is illustrated that one frame is divided into five sub-frames 1, 2, 3, 4, and 5. Here, a fifth sub-frame 5 corresponds to a blank sub-frame. Meanwhile, the number of sub-frames constituting one frame may be determined according to required conditions.

The method of FIG. 1A randomly performs scan operations of the sub-frames 1, 2, 3, 4, and 5 of all scan-lines by sequentially shifting each sub-frame scan timing of all scan-lines by a specific time, and thus randomly (i.e., separately) performs emission operations of the sub-frames 1, 2, 3, 4, and 5 of all scan-lines. Here, a sub-frame emission order for all scan-lines is fixed (e.g., in order of 1, 2, 3, 4 and 5). Each emission time of the sub-frames 1, 2, 3, and 4 is differently set. In addition, each emission time of the sub-frames 1, 2, 3, and 4 corresponds to each bit of a data signal. Further, each emission time of the sub-frames 1, 2, 3, and 4 (i.e., except for the fifth sub-frame 5) may differ by a factor of 2. For example, as illustrated in FIGS. 1A and 1B, an emission time of the second sub-frame 2 may be twice of an emission time of the first sub-frame 1, an emission time of the third sub-frame 3 may be twice of an emission time of the second sub-frame 2, and an emission time of the fourth sub-frame 4 may be twice of an emission time of the third sub-frame 3. Here, a sub-frame having the longest emission time (i.e., the fourth sub-frame 4) corresponds to the most significant bit (MSB) of the data signal, and a sub-frame having the shortest emission time (i.e., the first sub-frame 1) corresponds to the least significant bit (LSB) of the data signal. As a result, a specific gray level is implemented based on a sum of the emission times of the sub-frames 1, 2, 3, and 4.

However, as illustrated in FIGS. 1A and 1B, when the method of FIG. 1A divides one frame into the sub-frames 1, 2, 3, 4, and 5, a blank sub-frame that displays a black color (i.e., the fifth sub-frame 5) necessarily exist as one of the sub-frames 1, 2, 3, 4, and 5. Thus, a total emission time of one frame may be reduced by the fifth sub-frame 5. As a result, the method of FIG. 1A needs to increase a luminance to compensate a reduction of the total emission time. Hence, an element lifetime may be reduced in the organic light emitting display device. In addition, a display panel driving timing may be insufficiently achieved because it takes time to perform specific operations for the fifth sub-frame 5 in the organic light emitting display device. Further, charging-discharging power consumption for data-lines may be increased in the organic light emitting display device. To overcome these problems, a method of digital-driving an organic light emitting display device according to example embodiments may efficiently eliminate a blank sub-frame without influencing on a gray level implementation when dividing one frame into a plurality of sub-frames. Hereinafter, a method of digital-driving an organic light emitting display device according to example embodiments will be described in detail.

Figure 2:
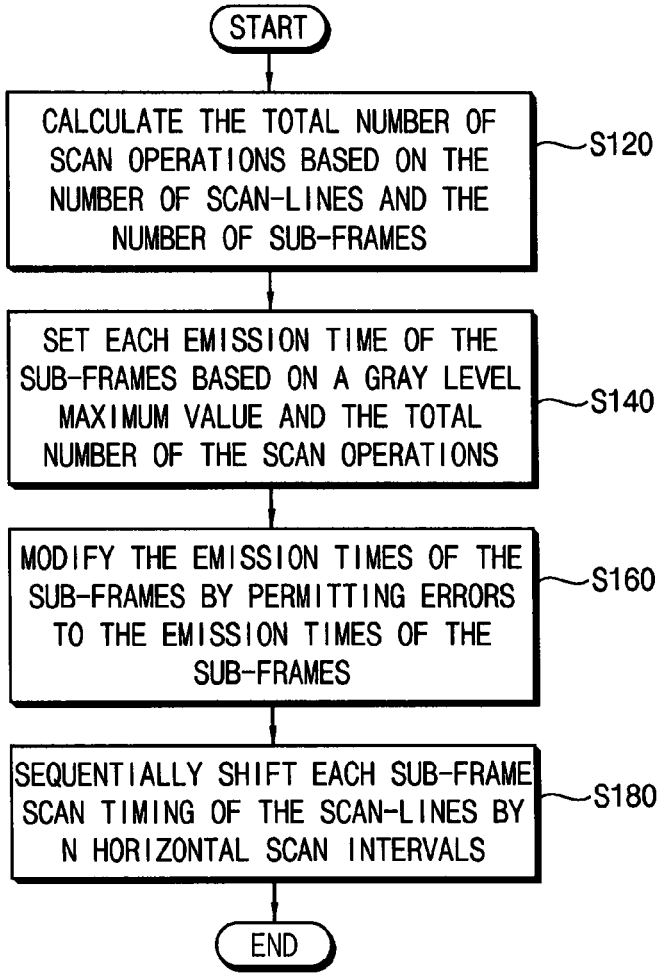
FIG. 2 is a flow chart illustrating a method of digital-driving an organic light emitting display device according to example embodiments.
Figure 3:
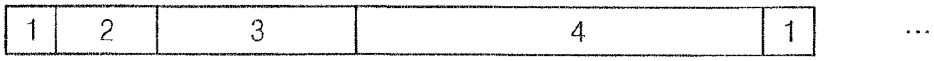
FIG. 3 is a diagram illustrating an example in which one frame is divided into a plurality of sub-frames by a method of FIG. 2.
Figure 4:
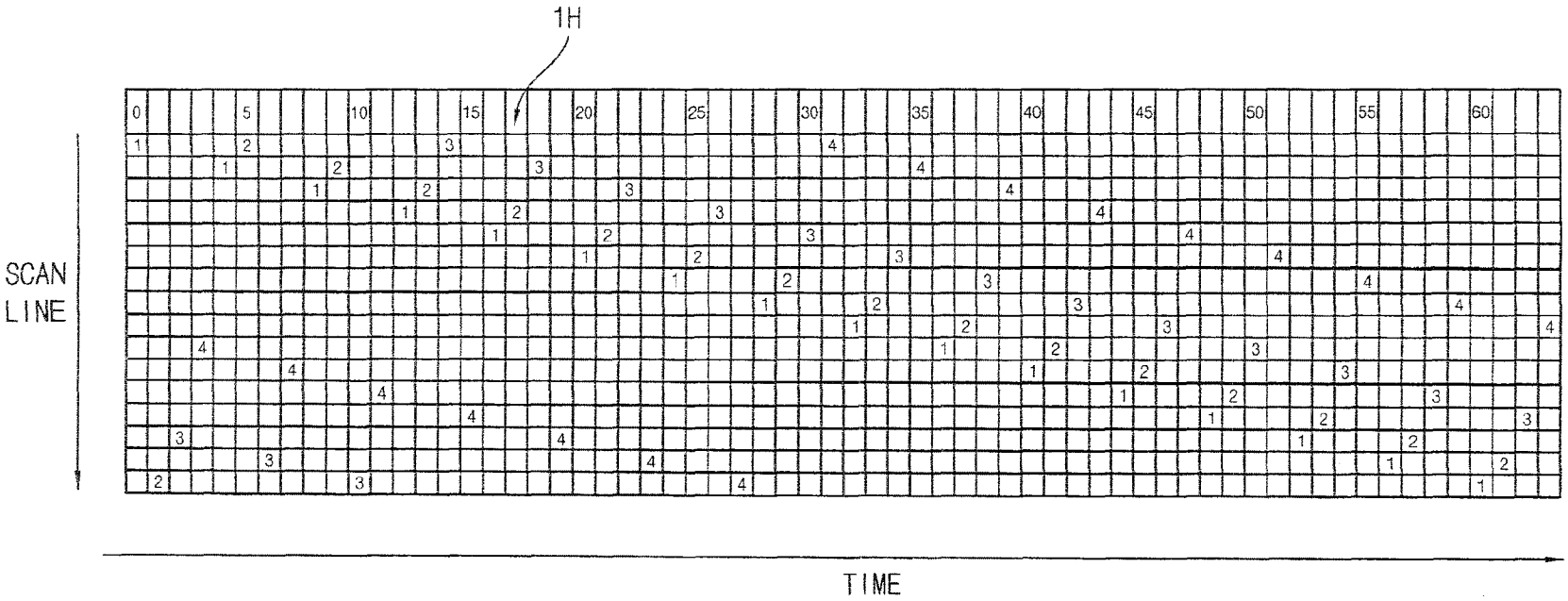
FIG. 4 is a diagram illustrating an example in which scan-lines are scanned by a method of FIG. 3.

FIG. 2 is a flow chart illustrating a method of digital-driving an organic light emitting display device according to example embodiments. FIG. 3 is a diagram illustrating an example in which one frame is divided into a plurality of sub-frames by a method of FIG. 2. FIG. 4 is a diagram illustrating an example in which scan-lines are scanned by a method of FIG. 3.

Referring to FIGS. 2 through 4, the method of FIG. 2 may display one frame by displaying a plurality of sub-frames 1, 2, 3, and 4. As illustrated in FIGS. 2 through 4, the method of FIG. 2 basically employs a digital driving technique of a random scan manner for the organic light emitting display device. In detail, the method of FIG. 2 may calculate the total number of scan operations that are performed during one frame based on the number of scan-lines and the number of the sub-frames 1, 2, 3, and 4 (Step S120), may set each emission time of the sub-frames 1, 2, 3, and 4 based on a gray level maximum value and the total number of the scan operations (Step S140), may modify the emission times of the sub-frames 1, 2, 3, and 4 by permitting errors to the emission times of the sub-frames 1, 2, 3, and 4 to control a sum of the emission times of the sub-frames 1, 2, 3, and 4 to be equal to the total number of the scan operations (Step S160), and may sequentially shift each sub-frame scan timing of the scan-lines 4 by N horizontal scan intervals, where N is the number of the sub-frames 1, 2, 3, and 4 (Step S180). As a result, as illustrated in FIGS. 3 and 4, one frame may be divided into the sub-frames 1, 2, 3, and 4 (i.e., no blank sub-frame exists). Here, each of the sub-frames 1, 2, 3, and 4 may correspond to each bit of a data signal, and a gray level may be implemented based on a sum of the emission times of the sub-frames 1, 2, 3, and 4. However, it should be understood that the number of sub-frames constituting one frame can be variously determined according to required conditions.

In detail, the method of FIG. 2 may calculate the total number of the scan operations that are performed during one frame based on the number of the scan-lines and the number of the sub-frames 1, 2, 3, and 4 (Step S120). In one example embodiment, a total time of one frame may be divided by a value that is generated by multiplying the number of the sub-frames 1, 2, 3, and 4 by the number of the scan-lines. That is, the total number of the scan operations may correspond to a value that is generated by multiplying the number of the sub-frames 1, 2, 3, and 4 by the number of the scan-lines. For example, when the number of the scan-lines is 16, and the number of the sub-frames 1, 2, 3, and 4 is 4, a total time of one frame may be 64(H) (i.e., 16*4=64), where H is a horizontal scan interval, and thus the total number of the scan operations may be 64. As described above, each of the sub-frames 1, 2, 3, and 4 may correspond to each bit of the data signal, and a gray level may be implemented based on a sum of the emission times of the sub-frames 1, 2, 3, and 4. Since a gray level needs to be linearly implemented based on each bit of the data signal, each emission time of the sub-frames 1, 2, 3, and 4 may differ by a factor of 2 (e.g., in order of increasing of the emission times of the sub-frames 1, 2, 3, and 4). For example, when the first sub-frame 1 has an emission time of 4(H), the second sub-frame 2 may have an emission time of 8(H), the third sub-frame 3 may have an emission time of 16(H), and the fourth sub-frame 4 may have an emission time of 32(H). In this case, a sum of the emission times of the sub-frames 1, 2, 3, and 4 is 60(H) (i.e., 4+8+16+32=60). That is, a sum of the emission times of the sub-frames 1, 2, 3, and 4 (i.e., 60(H)) is different from a total time of one frame (i.e., 64(H)). Therefore, in a conventional digital driving technique of a random scan manner for an organic light emitting display device, a blank sub-frame having an emission time of 4(H) necessarily exists. In the specification, the time or emission time is represented in a unit of a horizontal scan interval H. In other words, for example, the actual time period of the time of 64(H) is 64 times H, but the time 64(H) can be referred to as 64 in the unit of the horizontal scan interval H. For another example, the actual time period of the emission time 4(H) is 4 times H, but the emission time 4(H) can be referred to as 4 in the unit of the horizontal scan interval H. The number 64 and 4 in these examples are factors of the actual times, and are described as time and emission time, respectively, for the purpose of description.

However, the method of FIG. 2 may set each emission time of the sub-frames 1, 2, 3, and 4 differently from the conventional digital driving technique. In detail, the method of FIG. 2 may set each emission time of the sub-frames 1, 2, 3, and 4 based on the gray level maximum value and the total number of the scan operations (Step S140). In one example embodiment, when a value that is generated by multiplying the gray level maximum value by M, where M is a positive integer, is approximate to the total number of the scan operations, the shortest emission time among the emission times of the sub-frames 1, 2, 3, and 4 may be set as M horizontal scan intervals. In one example embodiment, the shortest emission time may be set when a value that is generated by multiplying the gray level maximum value by M is smaller than the total number of the scan operations. In another example embodiment, the shortest emission time may be set when a value that is generated by multiplying the gray level maximum value by M is greater than the total number of the scan operations. For example, when the number of the scan-lines is 16, and the number of the sub-frames 1, 2, 3, and 4 is 4, the total number of the scan operations may be 64. In addition, since the number of the sub-frames 1, 2, 3, and 4 is 4 (e.g., 4 bits), the gray level maximum value may be 15 (i.e., $2^4-1=15$). In this case, M may be 4 (i.e., 60/15=4). Thus, the method of FIG. 2 may set the shortest emission time as 4(H). Here, since each emission time of the sub-frames 1, 2, 3, and 4 differs by a factor of 2 in order of increasing of the emission times of the sub-frames 1, 2, 3, and 4, the first sub-frame 1 may have an emission time of 4(H), the second sub-frame may have an emission time of 8(H), the third sub-frame 3 may have an emission time of 16(H), and the fourth sub-frame 4 may have an emission time of 32(H).

In addition, a sum of the emission times of the sub-frames 1, 2, 3, and 4 is 60 (i.e. 4+8+16+32=60). Hence, there is a difference of 4 between the total number of the scan operations (i.e., 64) and a sum of the emission times of the sub-frames 1, 2, 3, and 4 (i.e., 60). Thus, the method of FIG. 2 may modify the emission times of the sub-frames 1, 2, 3, and 4 by permitting errors to the emission times of the sub-frames 1, 2, 3, and 4 to control a sum of the emission times of the sub-frames 1, 2, 3, and 4 to be equal to the total number of the scan operations (Step S160). In one example embodiment, the method of FIG. 2 may calculate a difference between the total number of the scan operations and a value that is generated by multiplying the gray level maximum value by M, where M is a positive integer, and may distribute the difference to the emission times of the sub-frames 1, 2, 3, and 4 while controlling the scan operations of the sub-frames 1, 2, 3, and 4 of one scan-line not to be overlapped by the scan operations of the sub-frames 1, 2, 3, and 4 of another scan-line. For example, when there is a difference of 4 (i.e., 64−60=4) between the total number of the scan operations (i.e., 64) and a value that is generated by multiplying the gray level maximum value by M (i.e., 60), the difference of 4 may be distributed to the emission times of the sub-frames 1, 2, 3, and 4. In this case, the first sub-frame 1 may have an emission time of 5(H), the second sub-frame 2 may have an emission time of 9(H), the third sub-frame 3 may have an emission time of 17(H), and the fourth sub-frame 4 may have an emission time of 33(H). That is, the difference of 4 may be distributed to the emission times of the sub-frames 1, 2, 3, and 4 by 1, respectively. As a result, a sum of the emission times of the sub-frames 1, 2, 3, and 4 may be equal to 64 (i.e., 5+9+17+33). In this manner, the method of FIG. 2 may efficiently eliminate a blank sub-frame when dividing one frame to a plurality of sub-frames.

Generally, in case of a full high definition television (FULL_HDTV), the number of scan-lines may be 1080, and one frame may be divided into twelve sub-frames. Hence, the total number of the scan operations that are performed during one frame may be 12960 (i.e., 1080*12=12960), and the gray level maximum value may be 255 (i.e., $2^8-1=255$) when a gray level of 8 bits is implemented. For example, it is assumed that a first sub-frame (i.e., a sub-frame having the shortest emission time) is set to have an emission time of 51(H), a sum of the emission times of the sub-frames may be 13005(H) when a gray level of 255 is implemented (i.e., 51*(1+2+4+8+16+32+64+128)=13005). Thus, a sum of the emission times of the sub-frames (i.e., 13005) is greater than the total number of the scan operations (i.e., 12960). That is, a sum of the emission times of the sub-frames (i.e., 13005) exceeds the total number of the scan operations (i.e., 12960) by 0.4%. Therefore, the method of FIG. 2 modify the emission times of the sub-frames by permitting errors to the emission times of the sub-frames. As a result, the method of FIG. 2 may eliminate a blank sub-frame by controlling the sum of the emission times to be equal to the total number of the scan operations (i.e., 12960). As described above, since one frame may be divided into 12 sub-frames but 13 sub-frames including one blank sub-frame, one horizontal scan interval (1H) may be increased by 8.3%, and average charging-discharging power consumption may be reduced by 8.3%. Here, errors may be caused when a gray level is implemented because the method of FIG. 2 permits errors to emission times of a plurality of sub-frames. However, since the number of the scan-lines is 1080, and one frame is divided into at least ten sub-frames (i.e., the total number of the scan operations that are performed during one frame is at least 10000), errors that are permitted to emission times of a plurality of sub-frames are negligible when a gray level is implemented.

Next, the method of FIG. 2 may sequentially shift each sub-frame scan timing of the scan-lines by N horizontal scan intervals, where N is the number of the sub-frames 1, 2, 3, and 4 (Step S180). In FIG. 4, since the number of the sub-frames 1, 2, 3, and 4 is 4, each sub-frame scan timing of the scan-lines may be sequentially shifted by 4(H). As a result, the method of FIG. 2 may randomly performs the scan operations of the sub-frames 1, 2, 3, and 4 of all scan-lines by sequentially shifting each sub-frame scan timing of all scan-lines by a specific time. In one example embodiment, as illustrated in FIG. 4, the method of FIG. 2 may set a sub-frame emission order for the sub-frames 1, 2, 3, and 4 in order of increasing of the emission times of the sub-frames 1, 2, 3, and 4 (i.e., in order of 1, 2, 3 and 4). In another example embodiment, the method of FIG. 2 may set a sub-frame emission order for the sub-frames 1, 2, 3, and 4 in order of decreasing of the emission times of the sub-frames 1, 2, 3, and 4 (i.e., in order of 4, 3, 2 and 1). As described above, the method of FIG. 2 efficiently eliminates a blank sub-frame to increase a total emission time when dividing one frame to a plurality of sub-frames. As a result, an element lifetime may be increased, a display panel driving timing may be sufficiently achieved, and charging-discharging power consumption for data-lines may be reduced in the organic light emitting display device.

Figure 5:
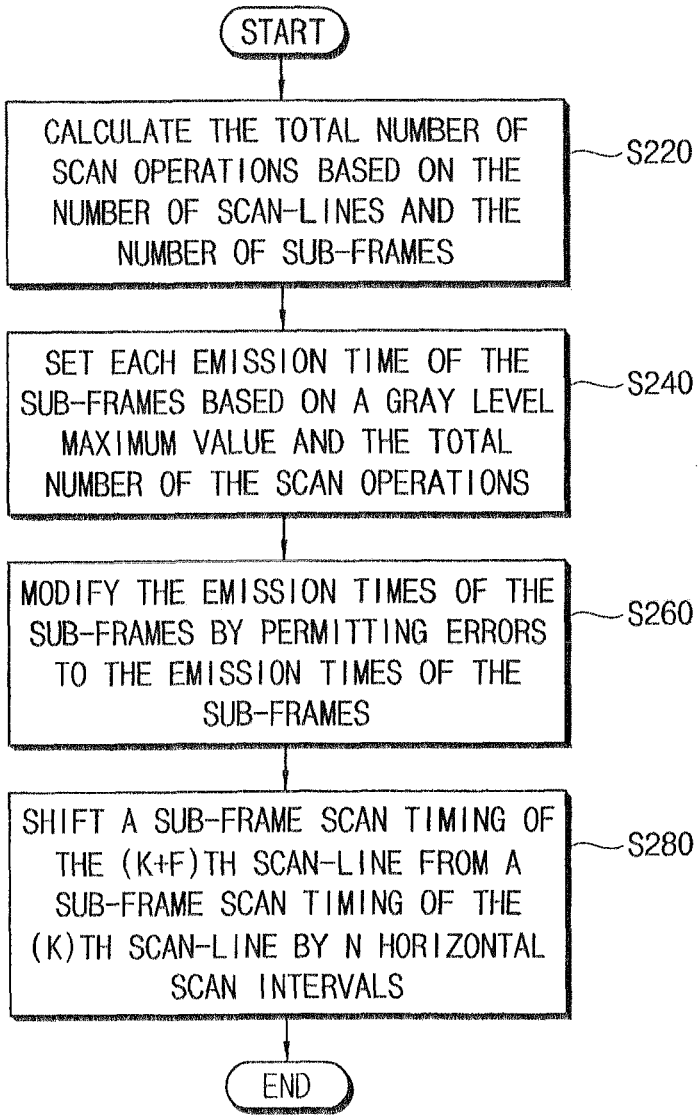
FIG. 5 is a flow chart illustrating a method of digital-driving an organic light emitting display device according to example embodiments.
Figure 6:
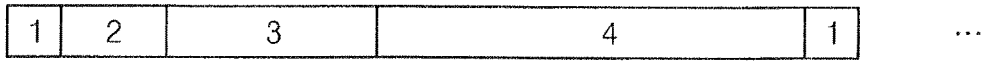
FIG. 6 is a diagram illustrating an example in which one frame is divided into a plurality of sub-frames by a method of FIG. 5.

FIG. 5 is a flow chart illustrating a method of digital-driving an organic light emitting display device according to example embodiments. FIG. 6 is a diagram illustrating an example in which one frame is divided into a plurality of sub-frames by a method of FIG. 5.

Referring to FIGS. 5 and 6, the method of FIG. 5 may display one frame by displaying a plurality of sub-frames 1, 2, 3, and 4. Here, the method of FIG. 5 may drive odd scan-lines and even scan-lines at an interval corresponding to 1/F frame, where F is an integer greater than or equal to 2. In detail, the method of FIG. 5 may calculate the total number of scan operations that are performed during one frame based on the number of scan-lines (i.e., the odd scan-lines and the even scan-lines) and the number of the sub-frames 1, 2, 3, and 4 (Step S220), may set each emission time of the sub-frames 1, 2, 3, and 4 based on a gray level maximum value and the total number of the scan operations (Step S240), may modify the emission times of the sub-frames 1, 2, 3, and 4 by permitting errors to the emission times of the sub-frames 1, 2, 3, and 4 to control a sum of the emission times of the sub-frames 1, 2, 3, and 4 to be equal to the total number of the scan operations (Step S260), and may shift a sub-frame scan timing of the (K+F)-th scan-line, where K is a positive integer, from a sub-frame scan timing of the K-th scan-line by N horizontal scan intervals, where N is the number of the sub-frames 1, 2, 3, and 4 (Step S280). As a result, as illustrated in FIG. 6, one frame may be divided into the sub-frames 1, 2, 3, and 4 (i.e., no blank sub-frame exists). Here, each of the sub-frames 1, 2, 3, and 4 may correspond to each bit of a data signal, and a gray level may be implemented based on a sum of the emission times of the sub-frames 1, 2, 3, and 4. Since Steps S120, S140, and S160 are described above, duplicated descriptions (i.e., Steps S220, S240, and S260) will be omitted. Hereinafter, the method of FIG. 5 will be described focusing on Step S280. As described above, it should be understood that the number of sub-frames constituting one frame is variously determined according to required conditions.

When displaying one frame by displaying a plurality of sub-frames, the method of FIG. 5 may efficiently eliminate a blank sub-frame by calculating the total number of the scan operations that are performed during one frame based on the number of the scan-lines and the number of the sub-frames 1, 2, 3, and 4 (Step S220), by setting each emission time of the sub-frames 1, 2, 3, and 4 based on the gray level maximum value and the total number of the scan operations (Step S240), and by modifying the emission times of the sub-frames by permitting errors to the emission times of the sub-frames 1, 2, 3, and 4 to control a sum of the emission times of the sub-frames 1, 2, 3, and 4 to be equal to the total number of the scan operations (Step S260). Next, the method of FIG. 5 may shift a sub-frame scan timing of the (K+F)-th scan-line from a sub-frame scan timing of the K-th scan-line by N horizontal scan intervals (Step S280) because the method of FIG. 5 drives the odd scan-lines and the even scan-lines at an interval corresponding to 1/F frame. For example, when the method of FIG. 5 drives the odd scan-lines and the even scan-lines at an interval corresponding to 1/2 frame, a sub-frame scan timing of the (K+2)-th scan-line may be shifted from a sub-frame scan timing of the K-th scan-line by 4(H) (i.e., the number of the sub-frames 1, 2, 3, and 4 is 4). For example, when the method of FIG. 5 drives the odd scan-lines and the even scan-lines at an interval corresponding to 1/3 frame, a sub-frame scan timing of the (K+3)-th scan-line may be shifted from a sub-frame scan timing of the K-th scan-line by 4(H) (i.e., the number of the sub-frames 1, 2, 3, and 4 is 4).

As described above, the method of FIG. 5 may efficiently eliminate a blank sub-frame to increase a total emission time when dividing one frame to a plurality of sub-frames. As a result, an element lifetime may be increased, a display panel driving timing may be sufficiently achieved, and charging-discharging power consumption for data-lines may be reduced in the organic light emitting display device. In addition, the method of FIG. 5 may properly arrange a plurality of sub-frames without a blank sub-frame for all scan-lines by shifting a sub-frame scan timing of the (K+F)-th scan-line from a sub-frame scan timing of the K-th scan-line by N horizontal scan intervals when driving the odd scan-lines and the even scan-lines at an interval corresponding to 1/F frame. As a result, the method of FIG. 5 may further prevent a dynamic false contour noise due to an emission time difference between the most significant bits (MSB) and the least significant bits (LSB) when a specific gray level is implemented because the method of FIG. 5 spatially disperses emissions of the most significant bits and emissions of the least significant bits. Hereinafter, referring to FIGS. 7 and 8, it will be described in detail that the odd scan-lines and the even scan-lines are driven at an interval corresponding to 1/F frame by the method of FIG. 5.

Figure 7:
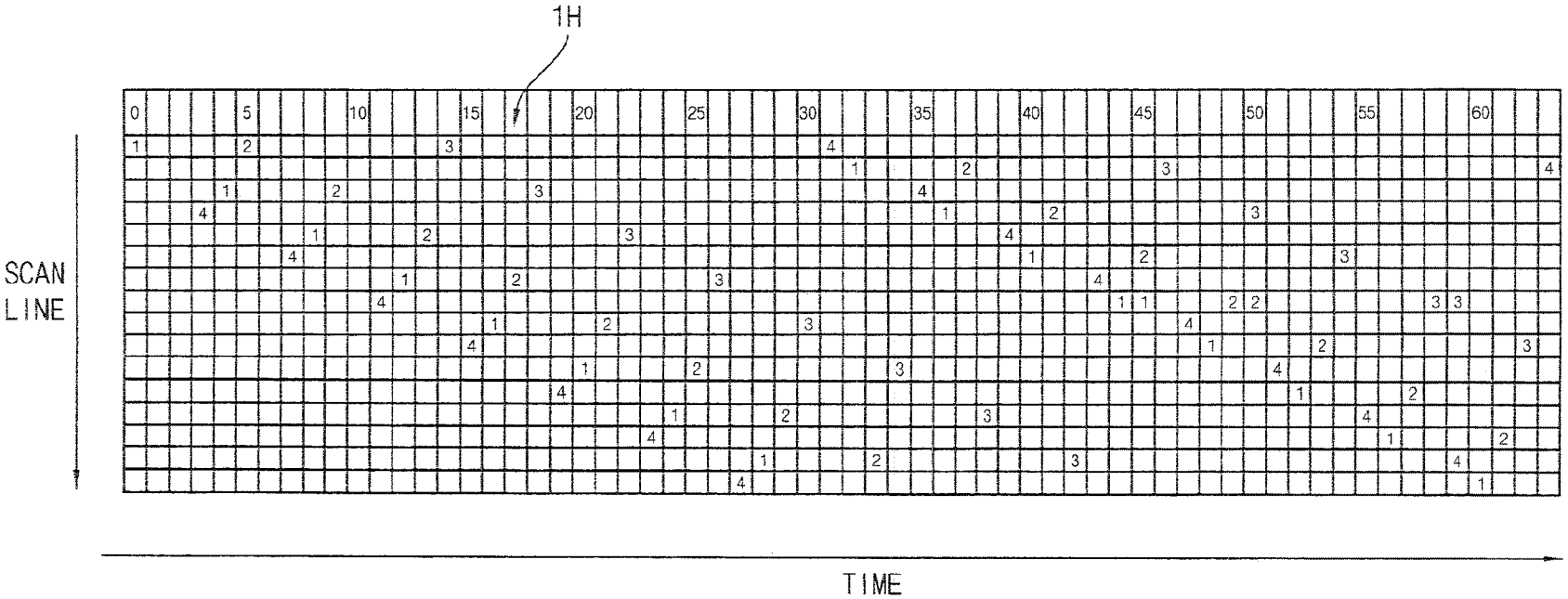
FIG. 7 is a diagram illustrating an example in which scan-lines are scanned by a method of FIG. 5.

FIG. 7 is a diagram illustrating an example in which scan-lines are scanned by a method of FIG. 5.

Referring to FIG. 7, it is illustrated that the method of FIG. 5 drives the odd scan-lines and the even scan-lines at an interval corresponding to 1/2 frame, and shifts a sub-frame scan timing of the (K+2)-th scan-line from a sub-frame scan timing of the K-th scan-line by N horizontal scan intervals, where N is the number of the sub-frames 1, 2, 3, and 4. That is, the method of FIG. 5 may employ an even odd inter-placed (EOI) digital driving technique.

As illustrated in FIG. 7, the method of FIG. 5 may drive the odd scan-lines and the even scan-lines at an interval corresponding to 1/2 frame. Here, one frame may be divided into a plurality of sub-frames 1, 2, 3, and 4 including no blank sub-frame. In addition, a sub-frame emission order for the sub-frames 1, 2, 3, and 4 may be set in order of increasing of the emission times of the sub-frames 1, 2, 3, and 4 (i.e., in order of 1, 2, 3 and 4). Further, sub-frame scan timings of the odd scan-lines may be shifted by a time corresponding to 1/2 frame from sub-frame scan timings of the even scan-lines. In this case, the method of FIG. 5 may shift a sub-frame scan timing of the (K+2)-th scan-line from a sub-frame scan timing of the K-th scan-line by N scan horizontal intervals (i.e., 4(H)), where N is the number of the sub-frames 1, 2, 3, and 4. For example, a sub-frame scan timing of the third scan-line may be shifted from a sub-frame scan timing of the first scan-line by 4(H), and a sub-frame scan timing of the fourth scan-line may be shifted from a sub-frame scan timing of the second scan-line by 4(H). As described above, the method of FIG. 5 may efficiently eliminate a blank sub-frame to increase a total emission time when dividing one frame to a plurality of sub-frames. In addition, the method of FIG. 5 may further prevent a dynamic false contour noise due to an emission time difference between the most significant bits and the least significant bits when a specific gray level is implemented because the method of FIG. 5 spatially disperses emissions of the most significant hits and emissions of the least significant bits.

Figure 8:
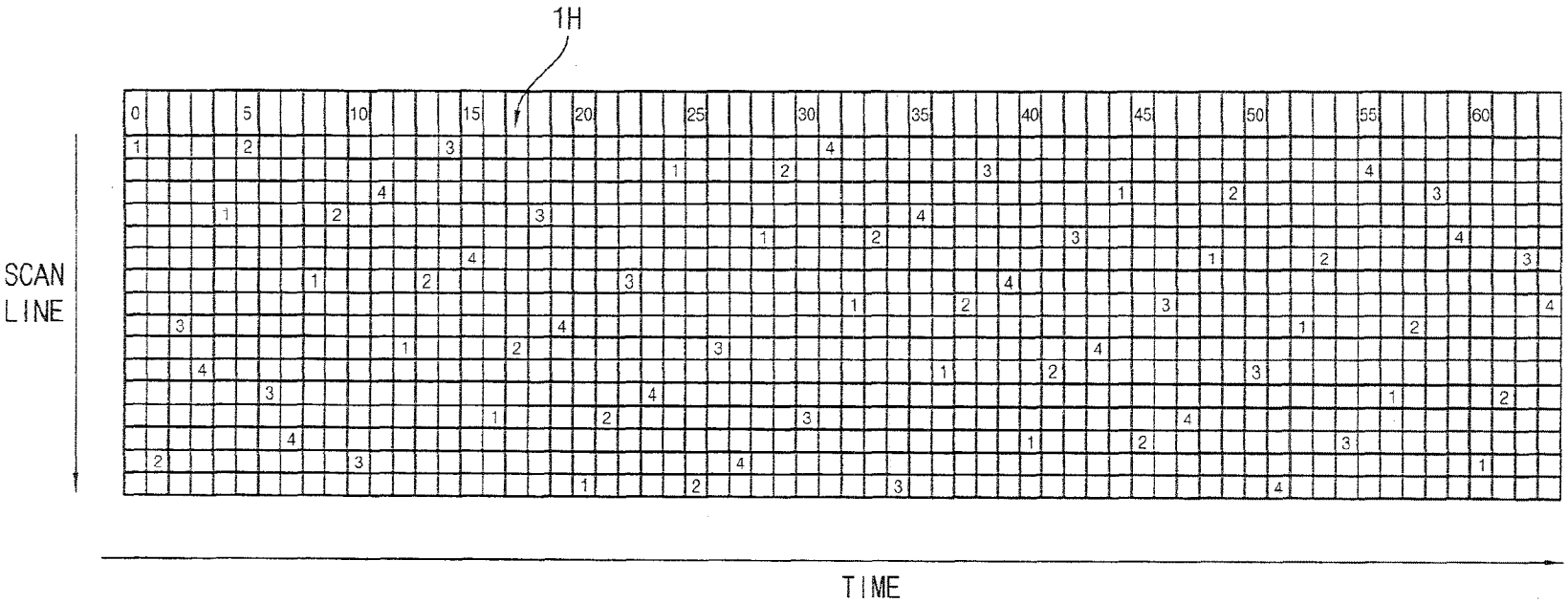
FIG. 8 is a diagram illustrating another example in which scan-lines are scanned by a method of FIG. 5.

FIG. 8 is a diagram illustrating another example in which scan-lines are scanned by a method of FIG. 5.

Referring to FIG. 8, it is illustrated that the method of FIG. 5 drives the odd scan-lines and the even scan-lines at an interval corresponding to 1/3 frame, and shifts a sub-frame scan timing of the (K+3)-th scan-line from a sub-frame scan timing of the (k)th scan-line by N horizontal scan intervals, where N is the number of the sub-frames 1, 2, 3, and 4. That is, the method of FIG. 5 may employ an even odd inter-placed (EOI) digital driving technique.

As illustrated in FIG. 8, the method of FIG. 5 may drive the odd scan-lines and the even scan-lines at an interval corresponding to 1/3 frame. Here, one frame may be divided into a plurality of sub-frames 1, 2, 3, and 4 including no blank sub-frame. In addition, a sub-frame emission order for the sub-frames 1, 2, 3, and 4 may be set in order of increasing of the emission times of the sub-frames 1, 2, 3, and 4 (i.e., in order of 1, 2, 3 and 4). Further, sub-frame scan timings of the odd scan-lines may be shifted from sub-frame scan timings of the even scan-lines by a time corresponding to 1/3 frame. In this case, the method of FIG. 5 may shift a sub-frame scan timing of the (K+3)-th scan-line from a sub-frame scan timing of the K-th scan-line by N scan horizontal intervals (i.e., 4(H)), where N is the number of the sub-frames 1, 2, 3, and 4. For example, a sub-frame scan timing of the fourth scan-line may be shifted from a sub-frame scan timing of the first scan-line by 4(H), and a sub-frame scan timing of the fifth scan-line may be shifted from a sub-frame scan timing of the second scan-line by 4(H). As described above, the method of FIG. 5 may efficiently eliminate a blank sub-frame to increase a total emission time when dividing one frame to a plurality of sub-frames. In addition, the method of FIG. 5 may further prevent a dynamic false contour noise due to an emission time difference between the most significant bits and the least significant bits when a specific gray level is implemented because the method of FIG. 5 spatially disperses emissions of the most significant bits and emissions of the least significant bits.

Figure 9:
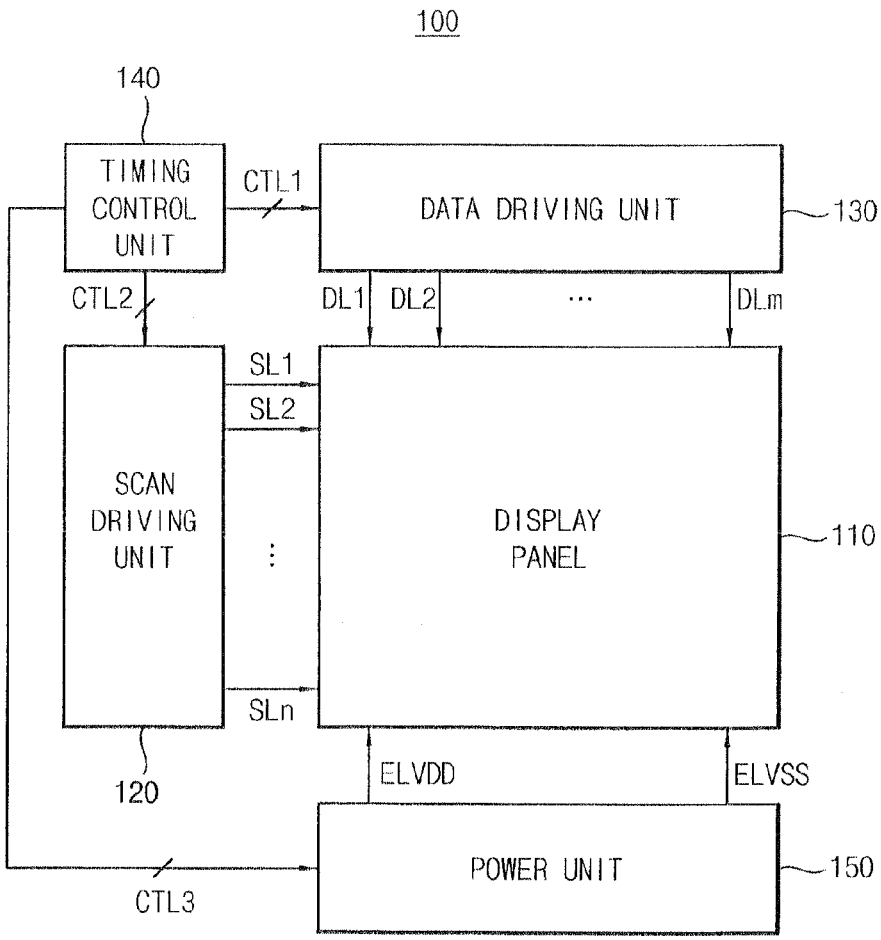
FIG. 9 is a block diagram illustrating an organic light emitting display device according to example embodiments.

FIG. 9 is a block diagram illustrating an organic light emitting display device according to example embodiments.

Referring to FIG. 9, an organic light emitting display device 100 may employ a method of digital-driving an organic light emitting display device according to example embodiments. Here, the organic light emitting display device 100 may include a display panel 110, a scan driving unit 120, a data driving unit 130, a timing control unit 140, and a power unit 150.

The display panel 110 may include a plurality of pixels. The scan driving unit 120 may provide a scan signal to the pixels via a plurality of scan-lines SL1 through SLn. The data driving unit 130 may provide a data signal to the pixels via a plurality of data-lines DL1 through DLm. The power unit 150 may generate a first power voltage ELVDD and a second power voltage ELVSS, and may provide the first power voltage ELVDD and the second power voltage ELVSS to the pixels via a plurality of power-lines. The timing control unit 140 may generate a plurality of control signals CTL1, CTL2, and CTL3 to control the scan driving unit 120, the data driving unit 130, and the power unit 150. As described above, when the pixels emit light in the organic light emitting display device 100, one frame may be divided into a plurality of sub-frames. That is, the organic light emitting display device 100 may display one frame by displaying a plurality of sub-frames. Here, a gray level may be implemented based on a sum of emission times of the sub-frames. For this operation, the scan driving unit 120 may randomly perform scan operations of the sub-frames of the scan-lines SL1 through SLn, and thus may randomly (i.e., separately) perform emission operations of the sub-frames of the scan-lines SL1 through SLn. In other words, by the method of digital-driving an organic light emitting display device, a scan signal may be applied to the scan-lines SL1 through SLn in random order for each sub-frame during one frame. In addition, the organic light emitting display device 100 may efficiently eliminate a blank sub-frame without influencing on a gray level implementation by calculating the total number of the scan operations that are performed during one frame based on the number of the scan-lines SL1 through SLn and the number of the sub-frames, by setting each emission time of the sub-frames based on a gray level maximum value and the total number of the scan operations, and by modifying the emission times of the sub-frames by permitting errors to the emission times of the sub-frames to control a sum of the emission times of the sub-frames to be equal to the total number of the scan operations. Since this operation is described above, duplicated descriptions will be omitted. Although it is illustrated in FIG. 9 that the organic light emitting display device 100 includes one scan driving unit 120, the organic light emitting display device 100 may include two scan driving units. In this case, one scan driving unit may be related to the odd scan-lines, and another scan driving unit may be related to the even scan-lines.

Figure 10:
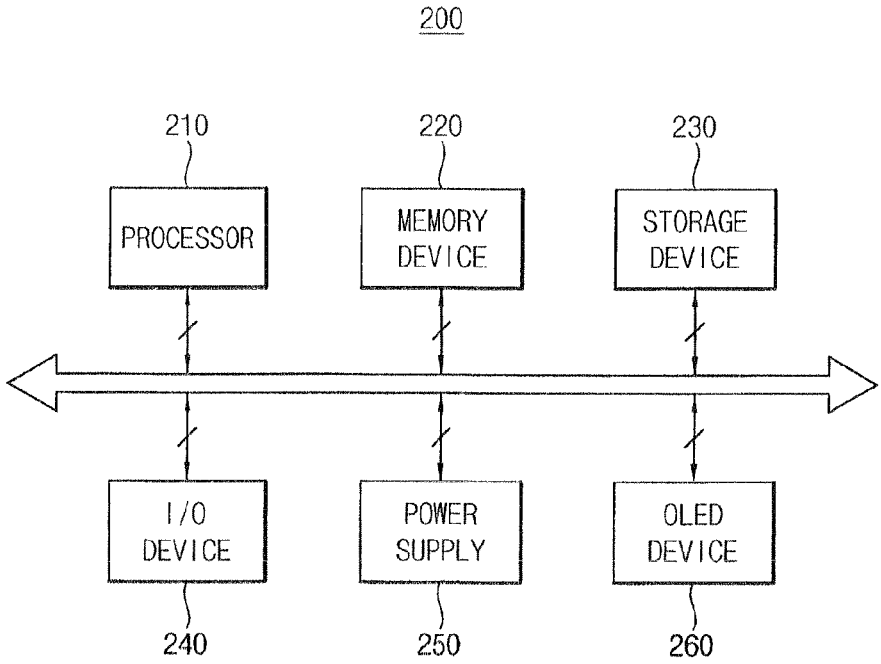
FIG. 10 is a block diagram illustrating an electric device having an organic light emitting display device of FIG. 9.

FIG. 10 is a block diagram illustrating an electric device having an organic light emitting display device of FIG. 9.

Referring to FIG. 10, an electric device 200 may include a processor 210, a memory device 220, a storage device 230, an input/output (I/O) device 240, a power supply 250, and an organic light emitting display device 260. Here, the organic light emitting display device 260 may correspond to the organic light emitting display device 100 of FIG. 9. The organic light emitting display device 260 may include a display panel, a scan driving unit, a data driving unit, a timing control unit, a power unit, etc. In addition, the electric device 200 may further include a plurality of ports for communicating a video card, a sound card, a memory card, a universal serial bus (USB) device, other electric devices, etc.

The processor 210 may perform various computing functions. The processor 210 may be a micro processor, a central processing unit (CPU), etc. The processor 210 may be coupled to other components via an address bus, a control bus, a data bus, etc. Further, the processor 210 may be coupled to an extended bus such as a peripheral component interconnection (PCI) bus. The memory device 220 may store data for operations of the electric device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc. The storage device 230 may be a solid state drive (SSD) device, a hard disk drive (HDD) device, a CD-ROM device, etc.

The I/O device 240 may be an input device such as a keyboard, a keypad, a mouse, a touch screen, etc, and an output device such as a printer, a speaker, etc. In some example embodiments, the organic light emitting display device 260 may be included as the output device in the I/O device 240. The power supply 250 may provide a power for operations of the electric device 200. The organic light emitting display device 260 may communicate with other components via the buses or other communication links. As described above, the organic light emitting display device 260 may efficiently eliminate a blank sub-frame to increase a total emission time when dividing one frame to a plurality of sub-frames. As a result, an element lifetime may be increased, a display panel driving timing may be sufficiently achieved, and charging-discharging power, consumption for data-lines may be reduced in the organic light emitting display device 260. In addition, the organic light emitting display device 260 may further prevent a dynamic false contour noise due to an emission time difference between the most significant bits and the least significant bits when a specific gray level is implemented because the organic light emitting display device 260 spatially disperses emissions of the most significant bits and emissions of the least significant bits. Since the organic light emitting display device 260 is described above, duplicated descriptions will be omitted.

The present inventive concept may be applied to an electric device having an organic light emitting display device. For example, the present inventive concept may be applied to a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of digital-driving an organic light emitting display device that divides one frame into a plurality of sub-frames, the method comprising:

calculating a total number of scan operations, which are to be performed during the frame, based on a number of scan-lines and a number of the sub-frames, the calculating the total number of the scan operations including setting the total number of the scan operations as a value that is generated by multiplying the number of the scan-lines by the number of the sub-frames;

setting an emission time of each of the sub-frames based on a gray level maximum value and the total number of the scan operations, the setting the emission time of the each of the sub-frames including setting the shortest emission time among of the emission times of the sub-frames as M horizontal scan intervals, where M is a positive integer, when a value that is generated by multiplying the gray level maximum value by M is approximate to the total number of the scan operations;

modifying the emission times of the sub-frames by permitting errors to the emission times of the sub-frames to control a sum of the emission times of the sub-frames to be equal to the total number of the scan operations; and sequentially shifting each sub-frame scan timing of the scan-lines by N horizontal scan intervals, where N is the number of the sub-frames.

2. The method of claim 1, wherein each of the sub-frames corresponds to each bit of a data signal, and a gray level is implemented based on the sum of the emission times of the sub-frames.

3. The method of claim 2, wherein a sub-frame having the longest emission time among the sub-frames corresponds to a most significant bit of the data signal, and a sub-frame having the shortest emission time among the sub-frames corresponds to a least significant bit of the data signal.

4. The method of claim 3, wherein a sub-frame emission order for the scan-lines is set in order of increasing of the emission times of the sub-frames.

5. The method of claim 3, wherein a sub-frame emission order for the scan-lines is set in order of decreasing of the emission times of the sub-frames.

6. The method of claim 1, wherein the each emission time of the sub-frames differs by a factor of 2.

7. The method of claim 1, wherein the modifying the emission times of the sub-frames includes:

calculating a difference between the total number of the scan operations and the value that is generated by multiplying the gray level maximum value by the M; and distributing the difference to the emission times of the sub-frames while controlling the scan operations of the sub-frames of one scan-line not to be overlapped by the scan operations of the sub-frames of another scan-line.

8. A method of digital-driving an organic light emitting display device that divides one frame into a plurality of sub-frames while driving odd scan-lines and even scan-lines at an interval corresponding to 1/F frame, where F is an integer greater than or equal to 2, the method comprising:

calculating a total number of scan operations, which are to be performed during the frame, based on a number of scan-lines and a number of the sub-frames;

setting an emission time of each of the sub-frames based on a gray level maximum value and the total number of the scan operations;

modifying the emission times of the sub-frames by permitting errors to the emission times of the sub-frames to control a sum of the emission times of the sub-frames to be equal to the total number of the scan operations; and shifting a sub-frame scan timing of a (K+F)-th scan-line, where K is a positive integer, from a sub-frame scan timing of a K-th scan-line by N horizontal scan intervals, where N is the number of the sub-frames.

9. The method of claim 8, wherein each of the sub-frames corresponds to each bit of a data signal, and a gray level is implemented based on the sum of the emission times of the sub-frames.

10. The method of claim 9, wherein a sub-frame having the longest emission time among the sub-frames corresponds to a most significant bit of the data signal, and a sub-frame having the shortest emission time among the sub-frames corresponds to a least significant bit of the data signal.

11. The method of claim 10, wherein a sub-frame emission order for the scan-lines is set in order of increasing of the emission times of the sub-frames.

12. The method of claim 10, wherein a sub-frame emission order for the scan-lines is set in order of decreasing of the emission times of the sub-frames.

13. The method of claim 8, wherein the calculating the total number of the scan operations includes:

setting the total number of the scan operations as a value that is generated by multiplying the number of the scan-lines by the number of the sub-frames.

14. The method of claim 13, wherein the setting the emission time of the each of the sub-frames includes:

setting the shortest emission time among the emission times of the sub-frames as M horizontal scan intervals, where M is a positive integer, when a value that is generated by multiplying the gray level maximum value by M is approximate to the total number of the scan operations.

15. The method of claim 14, wherein the each emission time of the sub-frames differs by a factor of 2.

16. The method of claim 14, wherein the modifying the emission times of the sub-frames includes:

calculating a difference between the total number of the scan operations and the value that is generated by multiplying the gray level maximum value by the M; and distributing the difference to the emission times of the sub-frames while controlling the scan operations of the sub-frames of one scan-line not to be overlapped by the scan operations of the sub-frames of another scan-line.

* * * * *